US005158277A

United States Patent [19]

Reist

[11] Patent Number: 5,158,277

[45] Date of Patent: Oct. 27, 1992

[54] METHOD AND APPARATUS FOR CONVEYING PRINTED PRODUCTS

[75] Inventor: Walter Reist, Hinwil, Switzerland

[73] Assignee: SFT AG Spontanfördertichnik, Weinfelden, Switzerland

[21] Appl. No.: 669,462

[22] Filed: Mar. 14, 1991

[30] Foreign Application Priority Data

May 21, 1990 [CH] Switzerland ..... 1697/90

[51] Int. Cl.[5] ..... B65H 5/12

[52] U.S. Cl. ..... 271/266; 271/225; 271/184; 271/268; 271/269; 198/774.3

[58] Field of Search ..... 271/183, 184, 202, 225, 271/266, 270, 267, 268, 269, 271; 221/213, 214, 215; 198/462, 577, 614, 774.3

[56] References Cited

U.S. PATENT DOCUMENTS

| | | | |
|---|---|---|---|
| 2,722,406 | 11/1955 | Kurek | 198/774.3 X |
| 3,417,858 | 12/1968 | Heard | 198/774.1 |
| 4,313,600 | 2/1982 | Mosburger | 271/270 X |
| 4,341,334 | 7/1982 | Bier | 271/270 X |
| 4,779,717 | 10/1988 | Eberle | 198/803.8 |
| 4,886,260 | 12/1989 | Reist | 270/60 |
| 5,004,092 | 4/1991 | Meier | 198/347.3 |

*Primary Examiner*—H. Grant Skaggs
*Assistant Examiner*—Carol Lynn Druzbick
*Attorney, Agent, or Firm*—Walter C. Farley

[57] ABSTRACT

A conveying method permits conveying of printed products, particularly in the form of a scale flow, with a constant or variable speed over conveying distances of random length, which can also contain rising or falling portions in the conveying direction, as well as curves. The method is based on the fact that each individual printed product or small group of printed products is conveyed by a conveying a element over a step length (S) which is small compared with the entire conveying distance and is then taken over by the next conveying element, while the first conveying element is moved back to its starting point. This process is repeated in a time cycle with the cycle length (T). The corresponding apparatus comprises a fixed support and a plurality of conveying elements, which are driven in a timed manner. A conveying distance or section can comprise a plurality of conveying modules, no transfer units being required between the individual modules. All the modules of a conveying section operate with the same timing cycle.

30 Claims, 9 Drawing Sheets

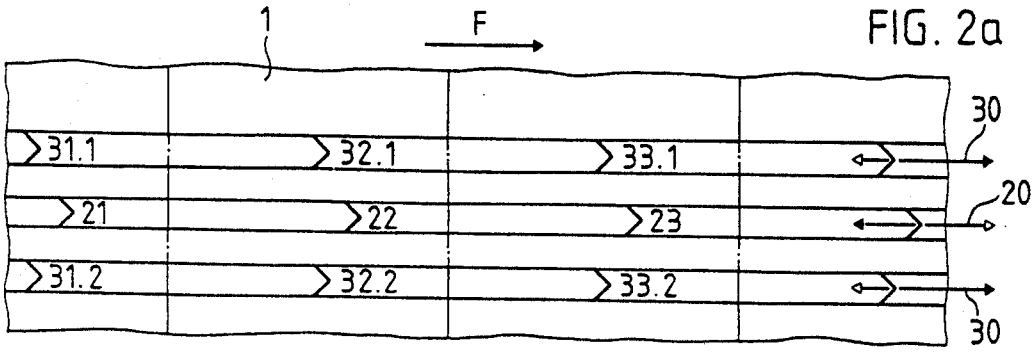
FIG. 2a
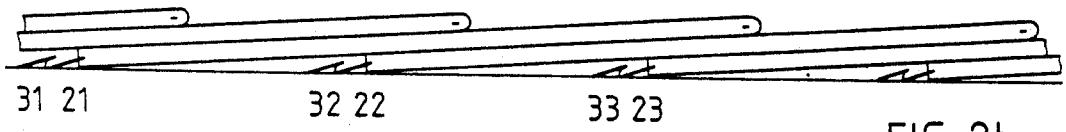
FIG. 2b
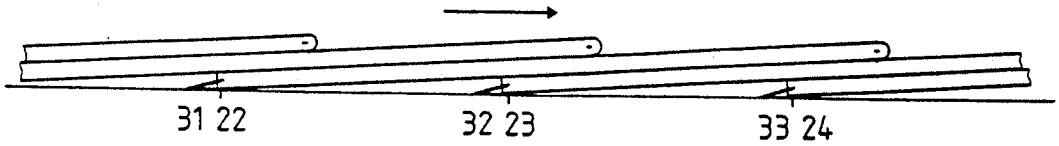
FIG. 2c
FIG. 3a
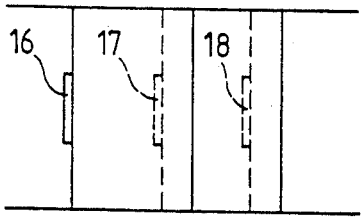
FIG. 3b
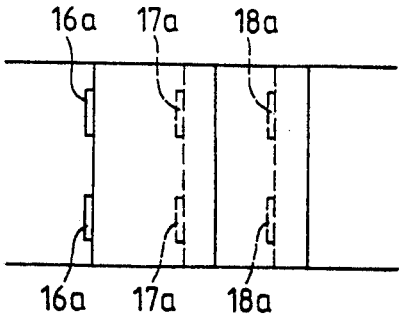
FIG. 3c
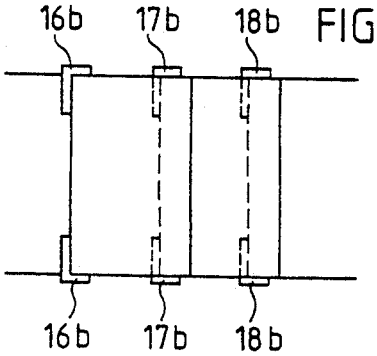
FIG. 4
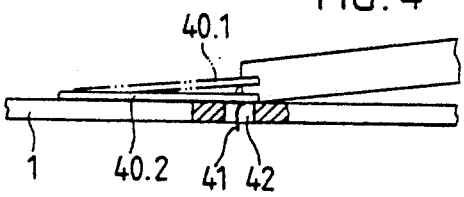

s
S
Ü2
Ü1
V
-V
93
93
92
91
90
x

METHOD AND APPARATUS FOR CONVEYING PRINTED PRODUCTS

FIELD OF THE INVENTION

The invention is in the field of printing works technology and relates to a method and an apparatus for conveying printed products, particularly for conveying printed products in the form of a scale flow.

BACKGROUND OF THE INVENTION

Before printed products are in their finished state, they can be processed by numerous different machines. Thus, following the rotary machine, newspapers pass through different working stations, e.g. an insertion device, an addressing station or a packing station. The printed products are normally conveyed between the individual machines in the form of a scale flow. Nowadays such conveying is more particularly carried out by conveyor belts or revolving chains with clamping elements operatively connected thereto.

In known installations, a conveyor belt linearly conveys in the forward direction and generally at a uniform speed the scale flow located thereon. It is only possible to overcome very slight up and down gradients unless use is made of special pressing means. Special conveying means must be located between the conveyor belts for curves. Although several conveyor belts can be joined together to form longer paths, the conveyed items must be large enough to be able to be pushed from one belt whilst they are still adequately supported on the next belt to permit further conveying thereof. However, as the scale flow often rests loosely on the conveyor belt, the individual scales can be reciprocally displaced in the conveying direction for a number of reasons and this can lead to irregularities in the scale flow and in certain circumstances to errors in the operating steps following conveying.

Chains with clamping elements operate in the same way as conveyor belts. However, as the scale flow or the individual elements thereof are secured by the clamping elements, it is possible to overcome up and down gradients, as well as curves. Conveyor systems comprising chains with clamping elements must be "tailor-made" for each particular application, because they cannot be assembled in a simple modular manner. A special transfer station is required between two conveying modules comprising chains with clamping elements.

Conveying with conveyor belts and conveyor systems with chains and clamping elements are restricted in that the scale flow must move uniformly over the entire conveying path comprising one or more conveyors. Thus, even in the case of slow conveying, it is not possible to insert even minor working steps for which it would be necessary to stop individual or several pieces for even a short time, without periodically stopping the entire conveyor belt or the complete series of conveyor belts. Conveyor belts and conveyor systems with rotary chains and clamping elements require a large amount of space for the unused return strand or side and in most cases have high construction cost.

SUMMARY OF THE INVENTION

An object of the present invention is to provide a conveying method and a conveying apparatus enabling printed products, and in particular printed products in a scale flow, to be continuously conveyed over a randomly long distance with substantially random up and down gradients and curves. The regular arrangement of the printed products in scale flow is to be automatically maintained, in that any irregularities which occur are permanently corrected out.

It must be possible to pull apart the scale flow at individual points of the conveying path and to compress, accelerate or decelerate the same in certain cases until the individual printed products are separated. It must also be possible at individual points along the conveying path to individually or groupwise stop the printed products, so that simple working steps can be performed thereon without having to stop the rest of the scale flow on the conveying path. The corresponding apparatus must be space-saving and modular-extendable, i.e. it must be possible to assemble a conveying path from individual conveying modules without involving significant costs.

BRIEF DESCRIPTION OF THE DRAWINGS

This object is achieved by the conveying method and apparatus embodiments of the which are described in greater detail hereinafter relative to the drawings, wherein:

FIGS. 2*a* to 2*c*: the working sequence for an exemplified embodiment of the inventive conveying apparatus.

FIGS. 3*a* to 3*c*: different embodiments of the conveying elements.

FIG. 4: a detail of a variant of a lowerable slide.

DESCRIPTION OF THE PREFERRED EMBODIMENT

Figure 1A:
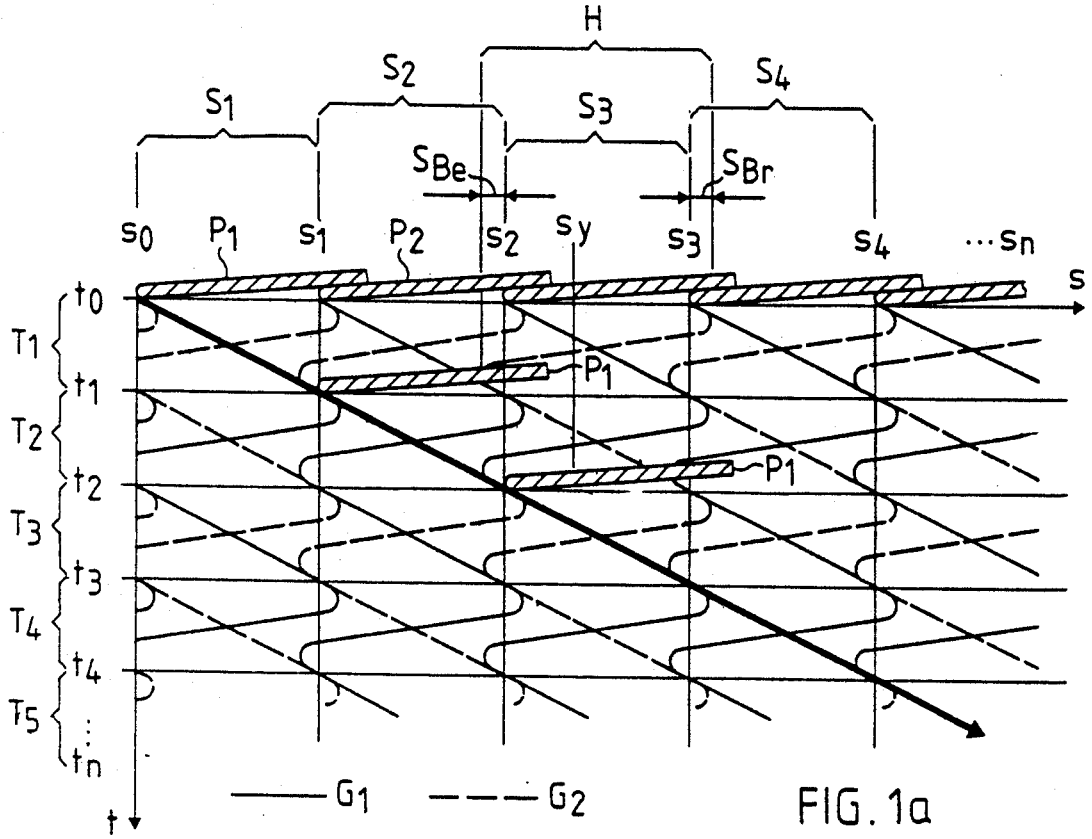
FIGS. 1*a* to 1*e*: different method diagrams.

The inventive conveying apparatus is directed to piece good-oriented timed conveying. Unlike conventional conveying means the conveying element (clamping device or bearing area on a conveyor belt, etc.) are not moved together with the printed product over a long distance but instead the printed product is "transferred" after very short conveying portions to the next conveying element. The inventive concept can be compared with the "bucket transfer principle" within a chain of firemen transporting buckets for the purpose of extinguishing a fire. Each man takes a bucket from the man in front of him, transports it over a short distance, transfers it to the following man and then moves back to take the next bucket. All the men in the chain must operate with the same time cycles, so that there is never an accumulation of buckets.

In modern printing works a system timing or clock for printed product processing and conveying imposed on the overall sequence is often necessary. Maintaining such a timing cycle or clock offers numerous different advantages, such as e.g. a transfer of printed products from one working step to the next. It must be borne in mind that the term "time cycle" is here defined by the time (cycle length) T elapsing between the passage of a printed product $P_n$ at a point x and the passage of the next printed product $P_{n+1}$ at the same point x. The way in which a printed product reaches the point x and which processes are performed thereon during the cycle length T must be freely determinable within the scope of the invention. Thus, the invention is mainly cycle-oriented and, as will be explained hereinafter, also cycle-maintaining or cycle-regenerating. This is unlike in conventional conveying means, which attribute minor significance to the timing cycle over a longer conveying distance, so that only during the following working step is it necessary to regenerate the cycle, e.g. because printed products have become reciprocally displaced on the conveyor belt.

The inventive conveying apparatus comprises a plurality of conveying elements, which convey one or more printed products over short distances or paths, then transfer the same to a further conveying element and then move back to the acceptance point. During each acceptance/transfer the timed sequence of printed products is regenerated. The conveying elements move with the same cycle, i.e. the time which elapses until they are again in the same position is the same for all the conveying elements of a conveying path.

FIGS. 1*a* to 1*e* show the inventive conveying method in graphs, in which the path s, i.e. the conveying path is plotted on the abscissa and the time t on the ordinate (at the bottom).

The method principle will be explained relative to FIG. 1*a*. At time $t_o$, as is diagrammatically indicated, the scale flow formed by the printed products $P_1 \ldots P_n$ is located on the conveying surface. At points $s_o \ldots s_n$ a conveying element acts on each printed product, but is not shown in the diagram. The conveying element can e.g. be a slide, which can in each case slide or move one printed product. During the time $T_1$ (first cycle length), i.e. from time $t_o$ to time $t_1$, the printed products are moved to the right by the conveying elements by in each case the step length $S_1 \ldots S_n$, so that at time $t_1$ the scale flow looks the same as at time $t_o$, but each printed product has moved to the right by one step length S, i.e. $P_1$ is now no longer in the vicinity of step length $S_1$, but in the vicinity of step length $S_2$. The corresponding movement of the conveying elements is indicated in continuous line form in the diagram (at first only the clock length $T_1$ is considered). At time $t_1$ each printed product is taken over or accepted by the next or following conveying element and is moved to the right by the latter by a further step length S during the second cycle length $T_2$ (the movement lines of these conveying elements are broken). During the same cycle length $T_2$ the conveying elements which conveyed during the cycle length $T_1$ are moved back to their original position (continuation of the continuous movement lines in the cycle length $T_2$), so that at time $t_2$ they are ready to accept and convey further printed products at points $s_o \ldots s_n$. Thus, at time $t_2$ the situation is the same as at time $t_o$.

It is a prerequisite of the method that all the time cycle lengths $T_1 \ldots T_n$ are the same, i.e. that there is a regular time cycling of the method. As will be explained relative to the further drawings, it is not a prerequisite that the step lengths $S_1 \ldots S_n$ and the speeds of the conveying elements are the same over the entire conveying distance or path. It is possible to switch between different cycle lengths, i.e. $T_n$ to a time $t_a \neq T_n$ to a time $t_b$. Thus, taking account of the functional sequence of the overall system, it is also possible to periodically modify the system cycle T in specific applications. The time t $(t_b - t_a)$ of switching one cycle length to another, etc. is generally much longer than the cycle length T ($t >> T$), which is e.g. 0.045 s for an hourly conveying capacity of 80,000 printed products.

The scale flow indicated in diagram 1*a* is conveyed in that a conveying element acts on each of the printed products. However, it would also be conceivable for a conveying element to act on a group and not on each printed product, but it might be necessary to specially design the conveying elements for this function.

The diagram makes it clear that the conveying apparatus must comprise conveying elements, which always convey over a relatively short step length S in the same region in the conveying path. It is also clear that the conveying elements can be combined into groups of synchronously moving conveying elements. In FIG. 1*a* there are two such groups, namely the group $G_1$ (with continuous movement lines), to which belong the elements conveying during the cycle length $T_1$, $T_3$, $T_5$, etc., and the group $G_2$ (with broken movement lines), to which belong the elements conveying during the cycle lengths $T_2$, $T_4$, $T_6$, etc. During the cycle lengths $T_2$, $T_4$, $T_6$, etc. the elements of the group $G_1$ are "passive" or perform a return movement (the same applies with regards to group $G_2$ during the cycle lengths $T_1$, $T_3$, $T_5$, etc.). The conveying elements are arranged on the conveying path in such a way that in each case one conveying element of group $G_1$ and one conveying element of group $G_2$ always convey over the same step length S. The conveying elements of the two groups move in a double cycle, i.e. their movement cycles take up a time which is twice the cycle length T. It is conveivable for more than two such groups of synchronously moved conveying elements to cooperate, e.g. three such groups. For three groups $G_1$, $G_2$ and $G_3$ of conveying elements, the diagram changes in such a way that each group of conveying elements conveys in the same way during a cycle length T, but instead of performing a movement cycle of two timing cycles as in FIG. 1*a*, it performs a 3 timing cycle movement. Thus, such a system operates in a triple cycle, in which the conveying elements are arranged on the conveying path in such a way that in each case one conveying element of each group conveys over each step length S and the groups are driven in such a way that the conveying elements of the individual groups convey in a regular sequence, e.g. $G_1$, $G_2$, $G_3$, $G_1$, $G_2$, $G_3$, etc.

The thick continuous arrow travelling from top left to bottom right diagonally through the diagram indicates the movement of the printed product $P_1$. Corresponding movement arrows can be placed through the diagram for all the other printed products of the scale flow. In the specific case the arrow is straight, i.e. the printed product is moved at a constant speed over the conveying path. Such conveying is of an optimum nature, but sets certain requirements with respect to the movements of the conveying elements. As the conveying elements move forwards and rearwards (based on the conveying direction), they always have a speed at the reversal points, which is equal to zero in the conveying direction. However, if a conveying element is only to convey when its speed in the conveying direction is constant, then it is not possible to utilize as a conveying path the distance over which the conveying element is accelerated to this speed, or the distance over which the conveying element is again decelerated. It can then be seen from FIG. 1*a* that the movement lines of the individual conveying elements overlap the step length S representing the conveying steps or paths, to the left by the accelerating distance $S_{Be}$ and to the right by the decelerating distance $S_{Br}$, so that the effective stroke or travel H of a conveying element is $S_{Be}+S+S_{Br}$. However, as it is a prerequisite of the method that the timing cycle is maintained, this means that one cycle length is required for conveying (to which corresponds the step length S) and the second cycle length is required for the deceleration of the forward movement, the reversal, the acceleration to the return movement, the deceleration, the reversal and the acceleration to the forward movement (distance $S_{Be}+H+S_{Br}$). It is clear from this that the return movement of an element must in each case take place at a higher speed than its forward movement. For this reason it is clear that a 3-cycle system can lead to advantages, two cycle lengths remaining for all the movements apart from the conveying movement.

Although in the example of FIG. 1*a* the conveying speed of the printed products is constant, which is often preferred, this does not constitute a prerequisite for the method. Systems can be obtained, in which the travel H and the step length S are of equal length and in which on passing from one timing cycle to the other the entire scale flow is decelerated and then accelerated again. The situation can also be such that firstly acceleration takes place over the entire step length, followed by deceleration or any other speed pattern can be adopted for conveying purposes. A disadvantage of such systems with specific speed patterns is the mechanical stressing to which a printed product is exposed during each acceleration and deceleration.

It can be derived from the method diagrams that the conveying elements must be designed in such a way that they can assume a conveying and a non-conveying configuration. They must be in the conveying configuration ("functional engagement with the printed product to be conveyed"), if they convey over the step length S and must be in the non-conveying configuration if they move rearwards. They are advantageously in their non-conveying configuration if they are accelerated over the distance $S_{Be}$ and are caught up by the corresponding, conveying preceding element and if they are decelerated over the distance $S_{Br}$ and overtaken by the corresponding, conveying following element. Only in this way is it ensured that the printed products are conveyed in a direction and are not influenced by (e.g. due to frictional effects) or do not follow the movement cycle of the conveying elements.

If for any reason a printed product of the scale flow is to be conveyed over and beyond the transfer point $s_n$ to a point $s_y$, it can still be grasped by the following conveying element and regularly reinserted into the scale flow if the point $s_y$ is still within the step length $S_{n+1}$ following the point $s_n$, i.e. the regularity of the scale flow is regenerated or corrected in each timing cycle.

Figure 1B:
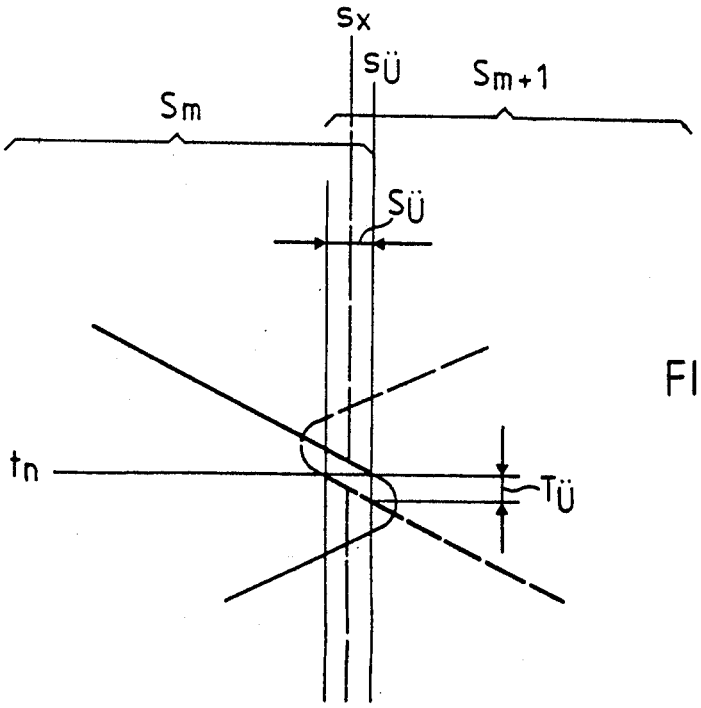

In order to achieve frictionless acceptance of the printed products from a conveying element, it is advantageous if at the instant of acceptance the accepting conveying elements move somewhat behind the transferring conveying elements. Thus, transfer can e.g. take place as shown in FIG. 1*b*, which shows the transfer procedure on a larger scale. The step lengths $S_m$ and $S_{m+1}$ overlap by the distance $S_U$ and the printed product is conveyed by the transferring conveying element to the point $s_U$ and is accepted there a brief instant $T_u$ later. It is advantageous to make the time $T_u$ as short as possible, so as not to interrupt the movement of the scale flow or the printed products to be transferred. It is also possible through a corresponding synchronization of the transitions of the conveying elements from the conveying to the non-conveying configuration, to ensure that the acceptance is not linked with a movement interruption (conveying configuration shown in FIG. 1*b* with thick movement lines and the non-conveying configuration with thin movement lines).

An advantage of the overlap of the step lengths S of the individual conveying elements is also that printed products which for some reason are not conveyed to the point $s_U$ and instead are e.g. only conveyed to a point $s_x$, can still be grasped by the next conveying element if the point $s_x$ is located within the path $S_U$, i.e. even such an irregularity is automatically corrected out during each cycle. The range of a possible correction can be influenced by a modified transition of the accepting conveying elements from the non-conveying to the conveying configuration.

Figure 1C:
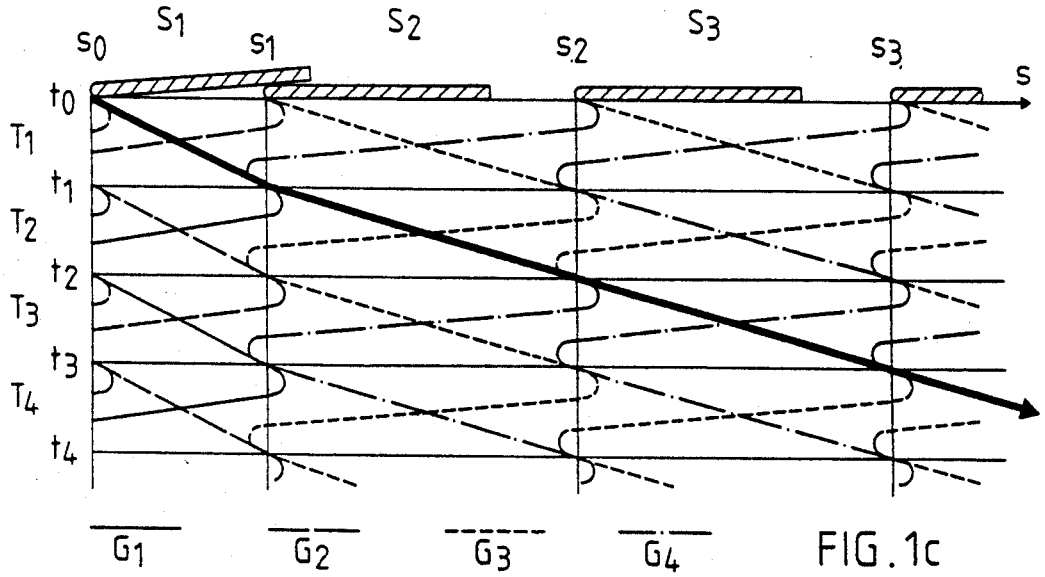

The diagram of FIG. 1*c*, which can be read in the same way as that of FIG. 1*a*, shows that with the inventive conveying method the scale flow can be pulled apart. It is so pulled apart in the represented example that the printed products are completely separated from one another, although this is not necessarily the case. In the vicinity of the step length $S_1$, the represented conveying distance corresponds to that of FIG. 1*a*. The following step lengths $S_2$, $S_3$, $S_4$, etc., are lengthened compared with $S_1$ and consequently the conveying speed must be increased (time cycle length T must remain constant). It is clear that the conveying speed on the right-hand side of the diagram is higher than on the left-hand side. However, it is also clear that the effective conveying capacity, i.e. the number of printed products conveyed over a certain distance per unit of time, cannot be modified in this way. The conveying elements which convey the scale flow to the point $s_1$, do not move in the same way as the conveying elements which convey the scale flow on from point $s_1$. They must therefore belong to different groups: group $G_1$ (continuous movement lines) and group $G_2$ (broken movement lines) to point $s_1$, group $G_3$ (dotted movement lines) and group $G_4$ (dot-dash movement lines) after point $s_1$.

Figure 1D:
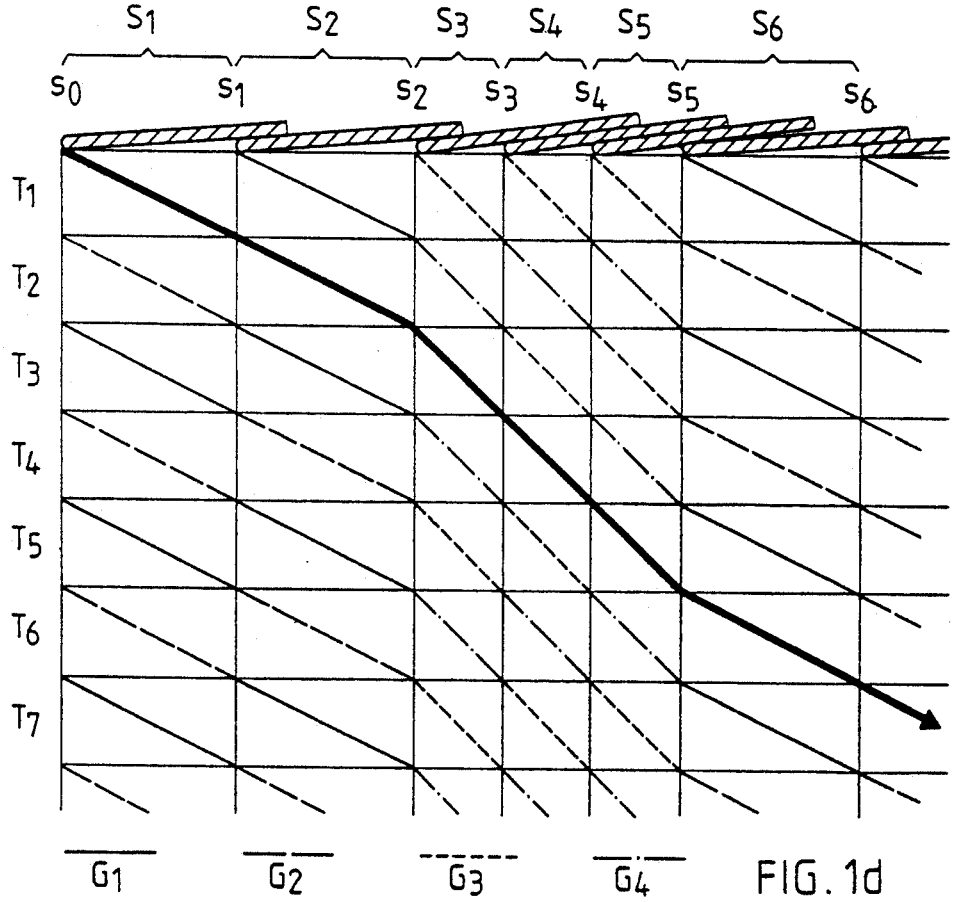

A corresponding shortening of the step length S leads to a compression of the scale flow and simultaneously to a slowing down, as is illustrated by FIG. 1*d*. For reasons of simplicity only the paths of the conveying elements are shown by the movement lines. Upstream of point $s_2$ and downstream of point $s_5$ conveying corresponds to that shown in FIG. 1*a*. In between these the step lengths are shortened and consequently the conveying speed is lower, so that the scale flow is more compressed. If individual, conveyed printed products (as over the step lengths $S_2$, $S_3$, $S_4$ etc. in FIG. 1*c*) are to be compressed to a scale flow, then corresponding mechanical means must ensure that the leading edges of the printed products in the conveying direction can slide in troublefree manner over the corresponding trailing edges of the preceding printed products in the conveying direction.

Figure 1E:
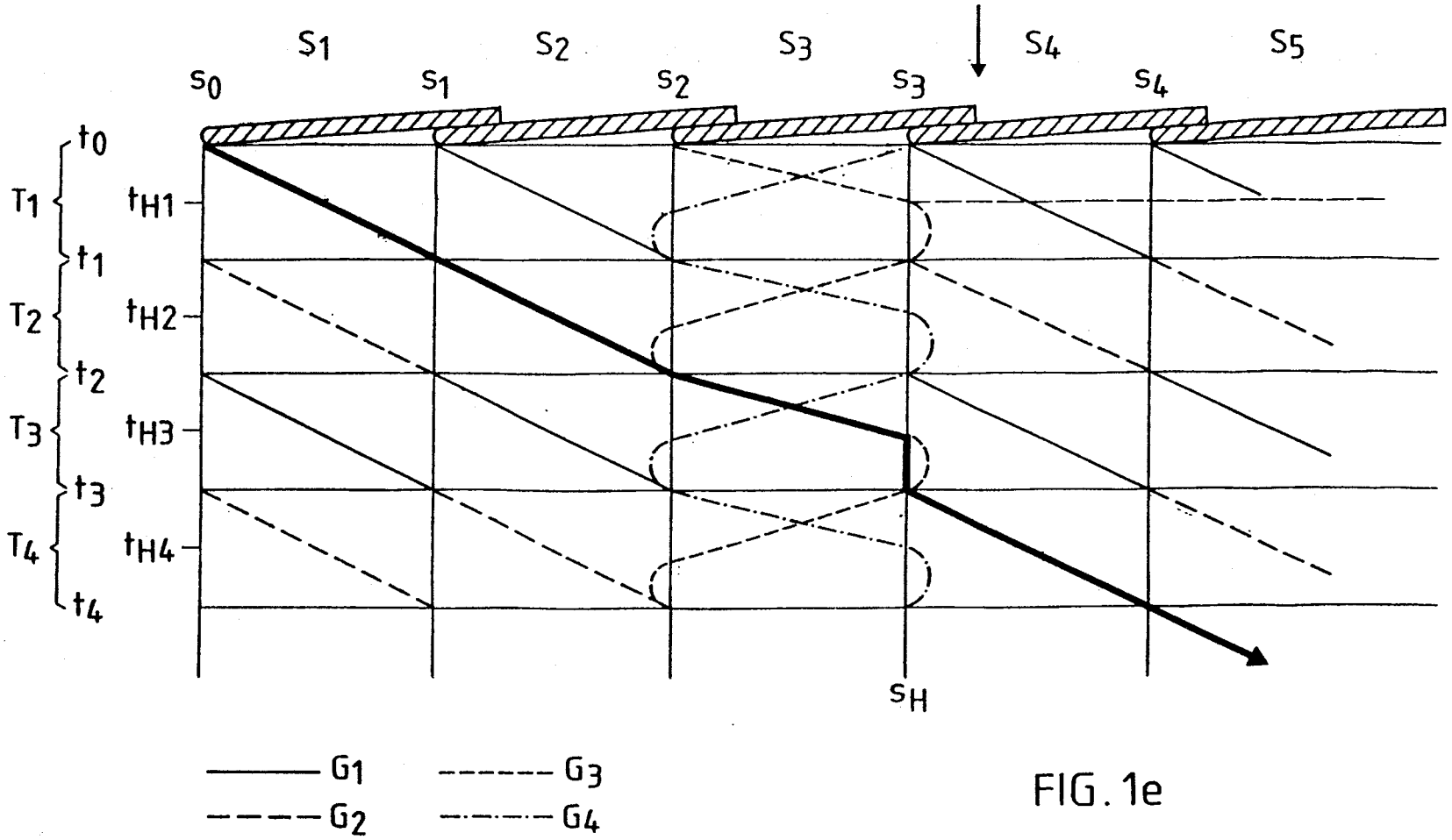

The diagram of FIG. 1*e*, which can be read in the same way as FIG. 1*a*, shows how it is possible with the inventive conveying method to stop each individual printed product, e.g. for a simple working step, without it being necessary to stop the entire conveying system or the entire scale flow. Up to point $s_2$ and following point $s_3$ conveying corresponds to that shown in FIG. 1*a*. For reasons of simplicity only the conveying steps of the conveying elements are shown with movement lines. Between the points $s_2$ and $s_3$ the step length $S_3$ occurs, which may or may not be the same as the other step lengths, but which can be overcome by the corresponding conveying elements in a time T', which is shorter than the cycle length T, in such a way that the printed product conveyed over this step must in each case wait for the time $T_H$ until it is conveyed on again by the next conveying element. For the corresponding times $T'+T_H=T$. The conveying elements moving over the step $S_3$ clearly have different movement cycles to the remaining conveying elements and therefore belong to other groups: $G_3$ (with dotted movement lines) and $G_4$ (with dot-dash movement lines).

In all the diagrams of FIGS. 1*a* to 1*e* the conveying paths are planar and straight. However, the inventive method is not restricted to conveying on such planar, straight conveying paths. Instead the conveying path can rise, fall or be curved. It is merely necessary to provide correspondingly designed means to ensure that no force other than that of the conveying elements acts in conveying manner on the printed products.

The description of the inventive method also shows that a corresponding apparatus can easily be assembled from different modules. One module then comprises a part of the conveying path from a point $s_m$ to a point $s_{m+n}$ with the corresponding number of conveying elements, which belong to the different groups and are e.g. driven groupwise. At the interfaces between the modules it must be ensured that the strokes or travels of the corresponding conveying elements at least slightly overlap. The time cycle length T must be the same for all the modules of a conveying path. The lengths of the travels H and step lengths S can differ and it is readily possible to combine together e.g. 2 and 3-cycle modules.

Due to the possibility of a modular construction for the inventive conveying apparatus, the latter has the major advantage that system extensions or adaptations can be carried out in a simple manner, in that a further module is connected in to an existing conveying module without additional transfer stations being necessary. Series connections are possible, i.e. two or more conveying modules are connected in succession and provide the possibility of longer conveying distances. However, parallel connections are also possible, i.e. over at least part of the conveying distance the scale flow is subdivided into two or more, parallel scale flows and these can also be brought together again. For such conveying system constructions, special modules are required at the branching and recombination points. It is e.g. possible to use the means described in U.S. Pat. No. 5,004,092.

As can be gathered from the described method, unlike in the case of conventional conveying means, the conveying elements do not all move on the same path (along a forward and return strand) and instead each conveying element describes its own path and is associated with a specific step length $S_1$, $S_2$, $S_3$. . . $S_n$.

A first embodiment of the inventive conveying apparatus, together with its working sequence is shown in FIGS. 2*a* to 2*c*. The conveying elements of a first group 20 thereof comprise in each case a lowerable slide 21, 22, 23 etc., while those of a second group 30 in each case comprise a pair of lowerable slides 31.½, 32.½, 33.½, etc. In their conveying configuration the slides are raised above the support or bearing surface 1, while they are lowered below the latter in their non-conveying configuration. The conveying direction is indicated by the arrow F. While the conveying elements of group 20 convey, the conveying elements of group 30 move back to the acceptance point and vice versa. FIGS. 2*a* and 2*b* represent the positions of the conveying elements at a time in which the group 20 will shortly end its conveying movement and the group 30 is accelerated or has already been accelerated for its conveying movement. The conveying steps of the two groups clearly overlap slightly (cf. FIG. 1*b*), because the transferring conveying elements of group 20 are positioned in the conveying direction F upstream of the accepting conveying elements of the group 30. At the instant of transfer both the slides of group 20 and also group 30 are raised above the support, i.e. are in the conveying configuration. As soon as the slides of group 30 have caught up with those of group 20, the slides of group 20 are lowered (below the bearing surface for the printing products), i.e. are brought into the non-conveying configuration and are moved rearwards, while the slides of the group 30 are conveyingly moved forwards in the raised state (conveying configuration). FIG. 2*c* shows the slides of the two groups at the time in which they intersect, group 20 being in the non-conveying configuration and group 30 in the conveying configuration.

Exemplified dimensions for a conveying module as shown in FIG. 2*a*–2*c* are stroke or travel H 100 mm, step length S 90% of H. A conveying module preferably has approximately 50 to 100 conveying elements.

As shown in FIGS. 2*a*–2*c*, the conveying elements 21, 22, etc., 31, 32, etc., can e.g. be constructed as lowerable slides, which can either be fitted in corresponding slots in the stationary support 1 or positioned laterally of the latter. The slides are differently arranged relative to the printed product flow. FIG. 3 shows some embodiments in diagrammatic plan view. A conveying element e.g. comprises at least one slide 16, 17, 18 (FIG. 3*a*) located in the centre of the printed product flow, or several narrow slides 16*a*, 17*a*, 18*a* (FIG. 3*b*) distributed over the width thereof. In order that the individual printed products do not tilt with respect to the support, the printed products can either be guided by lateral guides on the support or by correspondingly designed conveying elements. An example of conveying and at the same time guiding conveying elements with angular slide pairs 16*b*, 17*b*, 18*b* is shown in FIG. 3*c*. The angular slides 16*b*, 17*b*, 18*b* are in each case positioned laterally of the printed products. This embodiment has particular advantages if in each case one pair of slides of a conveying element is designed in such a way that the spacing of the slides can be adjusted to the width of different printed products to be conveyed. Correspondingly in place of slides it is also possible to use conventional clamping devices, such as are known from U.S. Pat. No. 4,779,717 of the present Applicant. The clamping devices maintain the product being conveyed at the start of the forwards step and release the same at the end of the latter. Such clamping devices must be openable and closable in a controlled manner. For example with the clamping device of U.S. Pat. No. 4,779,717, this can take place through a control link. The clamping device described therein can, in a preferred embodiment, be used for the present invention.

In the non-conveying configuration, such clamping devices can be lowered below the bearing surface, or can engage laterally of the individual printed products on the edges parallel to the conveying direction. In the latter cases the clamping devices need not be lowerable and are instead open in the non-conveying configuration. In another variant they can also be positioned laterally of the printing product flow, but grasp the entire thickness of the scale flow and not merely the individual printed products. Such an arrangement can be used without corresponding adjustment for scale flows of different product size or thickness (an adjustment only being required for different widths) and different printed product spacings.

FIG. 4 shows an embodiment of a lowerable slide, which can be used as a conveying element for an inventive conveying apparatus. The slide comprises a spring and is designed in such a way that the spring base 41 slides into a corresponding opening 42 in the support 1, if the slide is loaded by a printed product and consequently changes from its conveying configuration 40.1 into its non-conveying configuration 40.2. As soon as the slide is no longer loaded, it moves as a result of its spring action or driven by a corresponding link into its conveying configuration 40.1. Corresponding slides are described in U.S. Pat. No. 4,886,260 of the present Applicant.

Such slides can e.g. be modified by corresponding rubber strips or other resilient elements in such a way that in the conveying configuration they can be pushed by spring tension over the support, but can be drawn against the printed product by an oppositely acting force exerted by the rubber strip, so as to firmly secure the same.

Other variants for slides differ by the fact that they are not lowered below the bearing surface and are instead so constructed in streamline manner for the direction opposite to the conveying direction that, without being lowered, but still without disturbing the printed product flow, they can be moved rearwards. Such variants are particularly advantageous for thin printed products. It is readily possible to combine different conveying elements in such a way that e.g. one conveying module contains clamping devices and springs as conveying elements. However, preference is generally given to conveying modules having unitary conveying elements. Over longer conveying distances modules with different conveying elements can be connected in series.

For conveying paths having a marked downward gradient in the conveying direction so that friction is not sufficient to prevent the printed products from undesirably sliding forwards, clamping conveying elements are required. If in such cases clamping conveying elements are not used, the scale flow can also be pressed against the bearing surface by rolls, brushes or spring steel strips, so that as a result friction is increased. Such measures are also advantageous on rising conveying paths. The inventive conveying in which after very short portions a correction of the position or orientation of the printed products takes place (cycle regeneration) proves to be of great advantage. By means of the aforementioned, simple pressing means a precise positioning over long conveying paths cannot be ensured in the case of conventional conveying apparatuses.

Figure 5A:
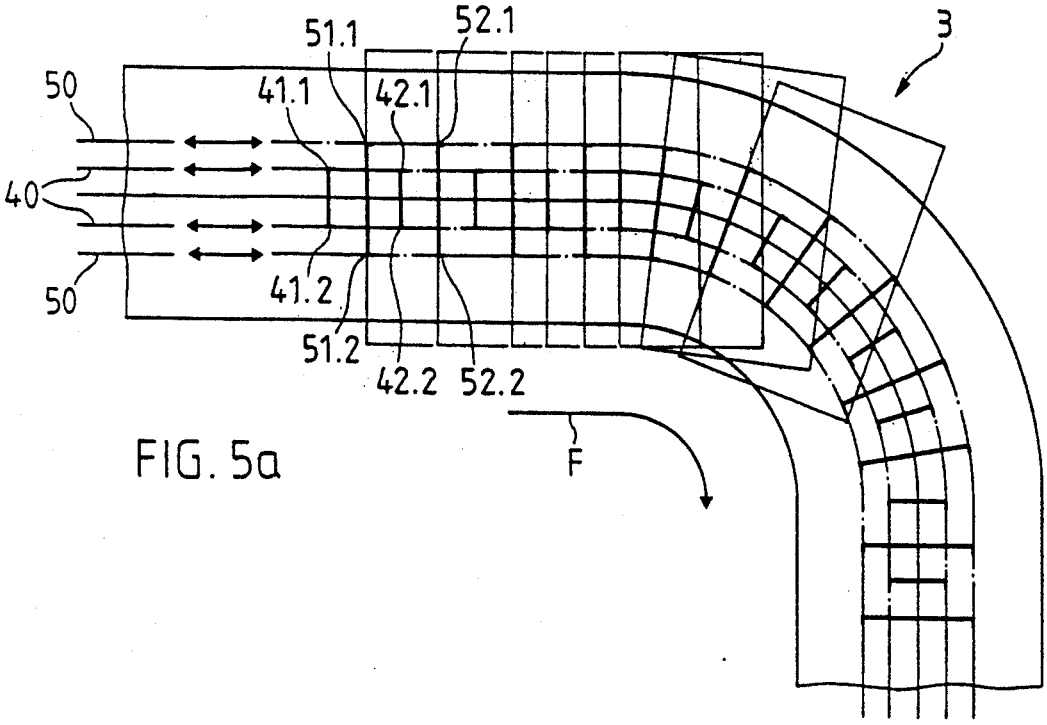
FIGS. 5*a* to 5*c*: a conveying path with curve.
Figure 5B:
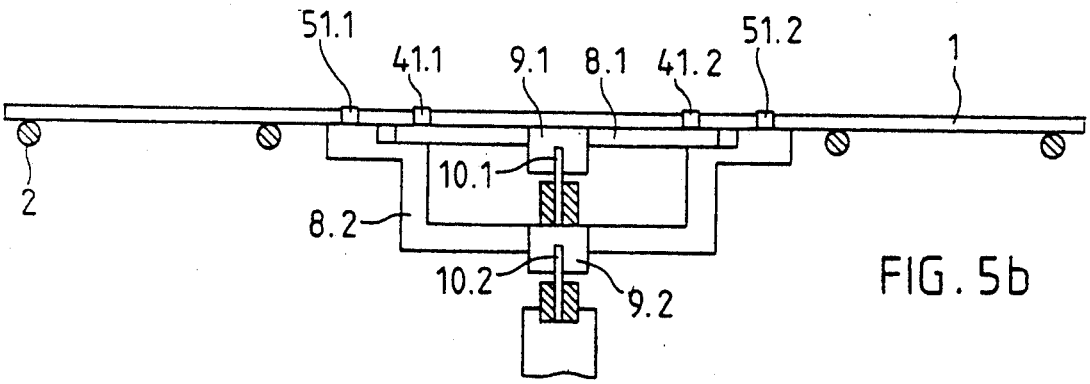

FIG. 5*a* shows an exemplified embodiment of the inventive conveying apparatus, which has a curved conveying path. The dot-dash line-indicated elements of a scale flow 3 are conveyed in the direction of the arrow F. The conveying elements of a first group 40 comprise slide pairs 41.½, 42.½, etc., arranged towards the centre of the scale flow, those of a second group 50 comprise slide pairs 51.½, 52.½, etc., directed towards the outside, etc. The working sequence of the system is identical to that described relative to FIG. 2. However, the slide pairs do not travel on a straight line and instead travel along a curve at least over a portion of the overall conveying path. An exemplified, associated drive mechanism can be seen in FIG. 5*b*. The slide pairs 41.½ and 51.½ are guided in corresponding, parallel slots of the support 1, the slides being mounted pairwise on cross-arms 8.1 and 8.2. In turn the cross-arms are mounted by means of connecting pieces 9.1 and 9.2 on two bendable carriers 10.1 and 10.2, e.g. spring steel strips parallel to the slots for the slides in the support, in such a way that the carrier 10.1 carries all the slide pairs of the group 40 and carrier 10.2 all the slide pairs of the group 50. The advantage of a single carrier 10.1, 10.2 per group of conveying elements is that the carrier can be positioned centrally on the "neutral line" of the conveying path. Thus, as can be gathered from FIG. 5*a*, in the curved region the conveying elements are in each case guided at right angles to the path of the curvature, i.e. the outer slides 41.1, 42.1, etc., 51.1, 52.1, etc., describe a path with a larger radius of curvature than the inner slides 41.2, 42.2, etc., 51.2, 52.2, etc. The carriers are so driven by various apparatus not shown in FIGS. 5*a*–5*c*, that they move backwards and forwards in opposite directions around the curve with the same timing cycle.

Figure 5C:
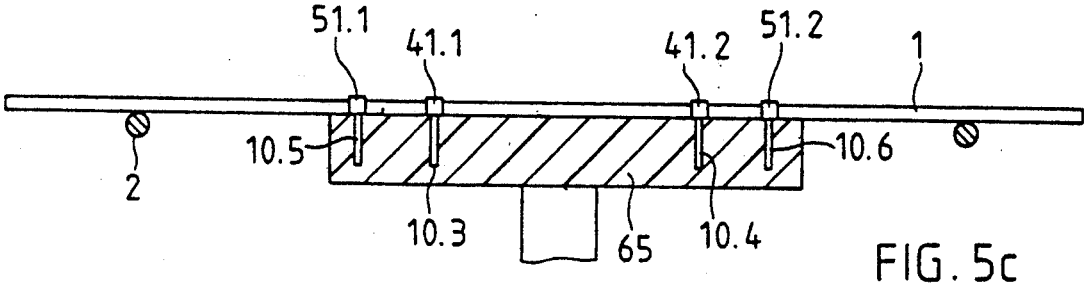

FIG. 5*c* shows another variant of the inventive conveying apparatus, which is particularly suitable for a curved conveying path. The slides are mounted in rows (i.e. for example 41.1, 42.1, 43.1, etc.) on four different, bendable carriers 10.3/4/5/6, which are mounted in a fixed guide element 65 with corresponding gaps or joints. The guide element is preferably designed for a lubricant-free operation and is e.g. made from plastic. As the strokes of the individual slide rows about a curve in the conveying path are not equally long (different radii of curvature in the vicinity of the curve), the individual carriers 10.3/4/5/6 must be driven by means of different or speed-variable gears.

According to another variant the slide rows of the same conveying module are driven with the same step length, i.e. the same gear, but as soon as the conveying path is curved the slides are omitted in one of two slide rows belonging to the same group. This variant has the advantage that one module with only one drive can cover both curved and straight conveying path portions.

Figure 6A:
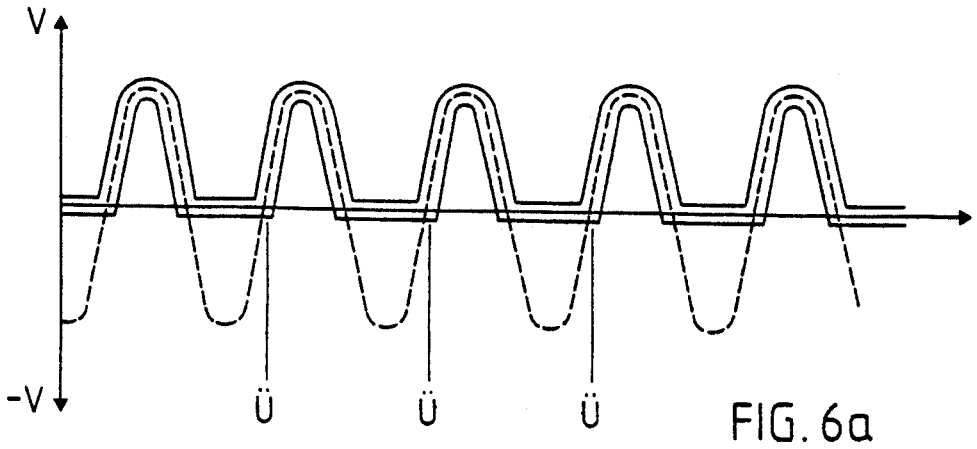
FIGS. 6*a* to 6*c*: different variants of the movement sequence.
Figure 6B:
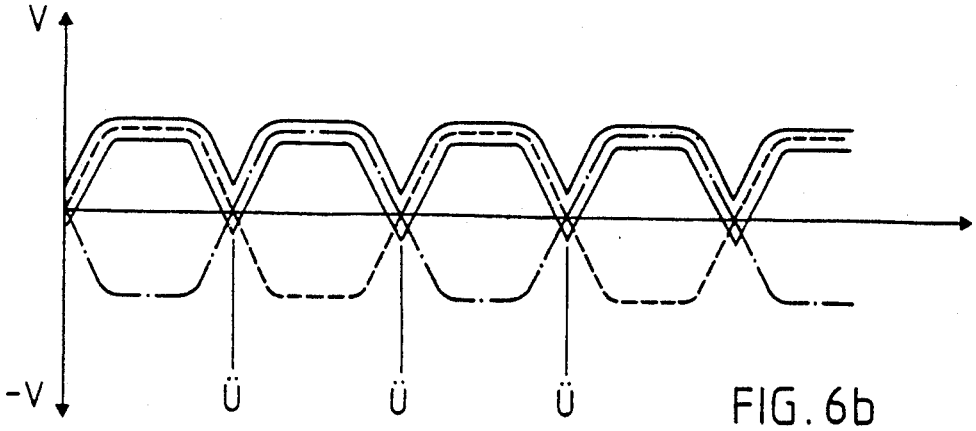
Figure 6C:
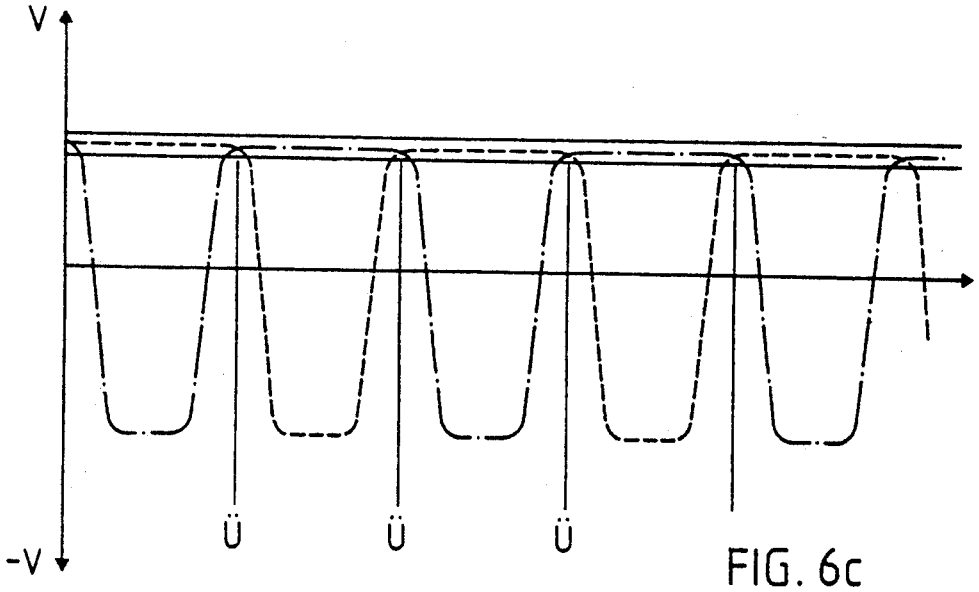

FIGS. 6*a* to 6*c* illustrate the time movement sequence of the timed conveying apparatus. The time is plotted on the abscissa and the speed on the ordinate, one speed being positive in the conveying direction and one speed negative counter to the conveying direction. FIG. 6*a* shows the time movement sequence for a conveying apparatus, which only comprises one group of conveying elements and which can be looked upon as the simplest, timed conveying apparatus and which allows a simple illustration of the different movement possibilities for the conveying elements. The oscillating curve (broken line) describes the movement of a conveying element, i.e. acceleration forwards, maximum sped forwards, deceleration to stationary, acceleration rearwards, maximum speed rearwards, deceleration to stationary, etc. The double continuous curve represents the movement sequence of the scale flow or a single element thereof, i.e. acceleration forwards, maximum speed forwards, deceleration to stationary, stationary during the reverse movement of the conveying elements, acceptance by the next conveying element and renewed acceleration forwards.

As a function of the drive and use, the precise shape of the oscillating curve can vary. Thus, in other words, the frequency and stroke are variable and the forward and reverse movement need not be of equal length from the time standpoint or symmetrical, the acceleration and deceleration need not be symmetrical and the time during which the scale flow is moved at maximum speed can be of varying length. It is obviously also unnecessary for the printed products to be engaged precisely at the reversal point, i.e. during the zero passage of the speed curve and it is in fact also possible that it takes place after a short time lag $\Delta t$ when the conveying element already has a limited speed v. For this simple embodiment of the conveying apparatus with only one group of conveying elements, the scale flow is stationary, while the conveying elements move rearwards.

FIG. 6*b* shows an exemplified movement sequence for an inventive conveying apparatus with two groups of conveying elements. The two superimposed, oscillating curves (shown in dot-dash and broken line form) together represent the movement sequences of the two combined, single conveying modules. The double-continuous curve again represents the movement sequence of the scale flow or one element thereof. It shows acceleration forwards, maximum speed forwards, deceleration to stationary, acceptance U by the conveying elements of the other group, acceleration forwards, maximum speed forwards, etc. It is obvious that for the same step length and the same timing cycle, the conveying path per time unit is twice as long for the embodiment with two groups of conveying elements as in the embodiment for only one such group (FIG. 6*a*). The movement sequence shown in FIG. 6*b* still leads to the elements of the scale flow being stationary at each transfer, because this always takes place precisely at the reversal point of the conveying elements.

The continuous movement of the scale flow is advantageous for energy reasons, because the multiple acceleration and deceleration of the printed products is unnecessary and because undesired deformations and displacements of the printed products, which can result from accelerations are prevented. In order to obtain a continuous movement at a constant speed, movement sequences must be brought about e.g. in the manner shown in FIG. 6*c*. The oscillating curves (shown in dot-dash and broken line form) once again represent the movement sequences of the two groups of conveying elements. The reverse movement is shorter than the forward movement and, as the same distance must be covered, the maximum speed for the same acceleration and deceleration is somewhat higher. The double-continuous curve, which in this case is a straight line, represents the movement sequence of the scale flow or one element thereof, which here moves forwards at a constant speed. The acceptance U by the conveying elements of the other, single conveying module no longer takes place at the reversal point of the conveying elements, but instead at the starting or finishing point of the phase with maximum speed in the forwards direction. A movement sequence for the conveying elements shown in FIG. 6*c* is in accordance with the explanations concerning the conveying method given in conjunction with FIG. 1.

A constant scale flow speed can also be achieved if the two oscillating curves of FIG. 6*b* have a third curve superimposed thereon and which has a phase displacement, i.e. if instead of two, three or possibly even more groups of conveying elements are combined to form a conveying apparatus. However, such a system would only be used for special applications due to the increased costs compared with the system shown in FIG. 6*c*.

If, as is required by the set problem of the inventive apparatus, it has to be possible for the individual elements of the scale flow to stop for a short time during the conveying process at one or more specific locations to enable work to be carried out, as a further variant to that of FIG. 1*c* at the particular point can be provided a conveying module, which operates with a group of conveying elements. In order that the said conveying module can cooperate with the other conveying modules e.g. functioning with two groups of conveying elements, its working cycle must be twice as fast. If its conveying step is chosen correspondingly short, this can be brought about by using the same technical means. Stops can also be brought about by movement sequences as shown in FIG. 6*b*, but the phase displacement between the two oscillating curves is not 180°.

FIGS. 7, 8 and 9 show drives and gears usable for driving the conveying systems according to the invention. They merely show examples of gears for the inventive conveying apparatus and other gears can obviously also be used. The choice of gear is dependent on the choice of drive. Virtually any type of motor can be used as a drive for the inventive timed conveying apparatus.

Figure 7A:
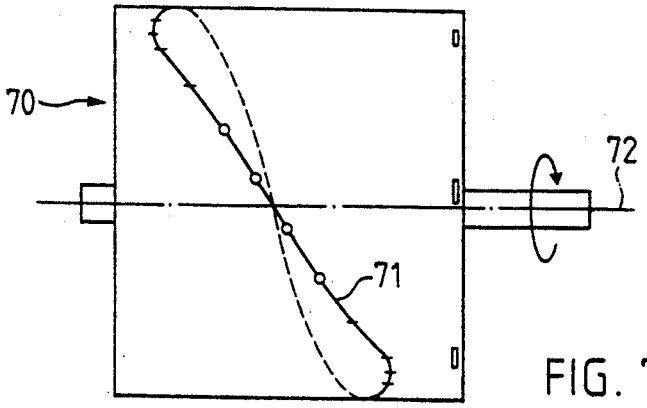
FIGS. 7*a*/7*b*: a variant of a gear for the inventive conveying apparatus.
Figure 7B:
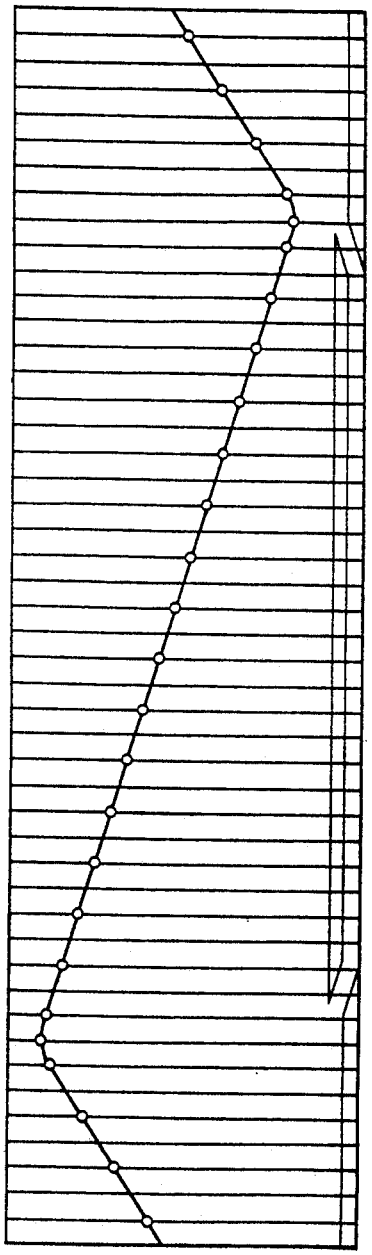

FIG. 7*a* shows a simple gear with a movement link or cam. The cylindrical surface of the cylinder 70 carries a continuous groove 71, which passes around the cylinder e.g. in the represented manner and serves as a movement cam. A sliding shoe (not shown) projects into the groove and is firmly connected to the correspondingly guided carrier of the conveying elements of the inventive conveying module and moves in the manner shown in the developed view of FIG. 7*b* when the cylinder 70 is rotated about its axis 72. By a corresponding variation of the cylinder diameter, the rotational speed of the cylinder and the shape of the groove, it is possible to adapt the movement sequence of the sliding shoe and consequently the conveying elements to different requirements.

Figure 8A:
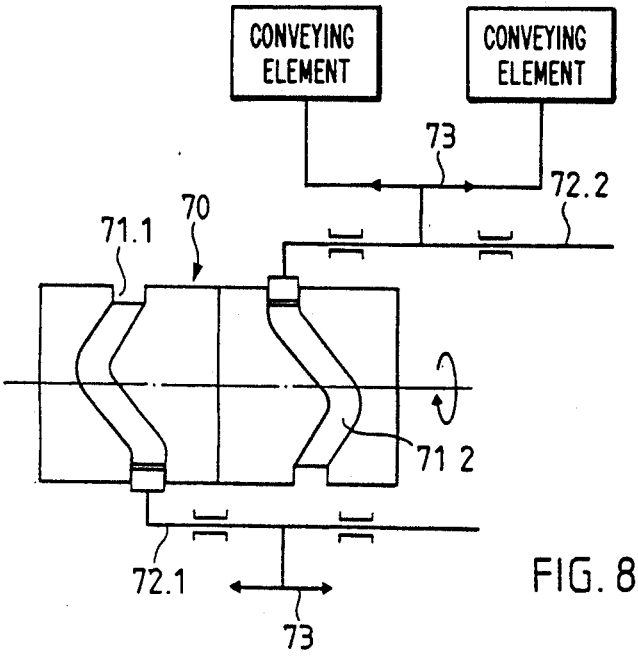
FIGS. 8*a*/8*b*: further variants of gears.
Figure 8B:
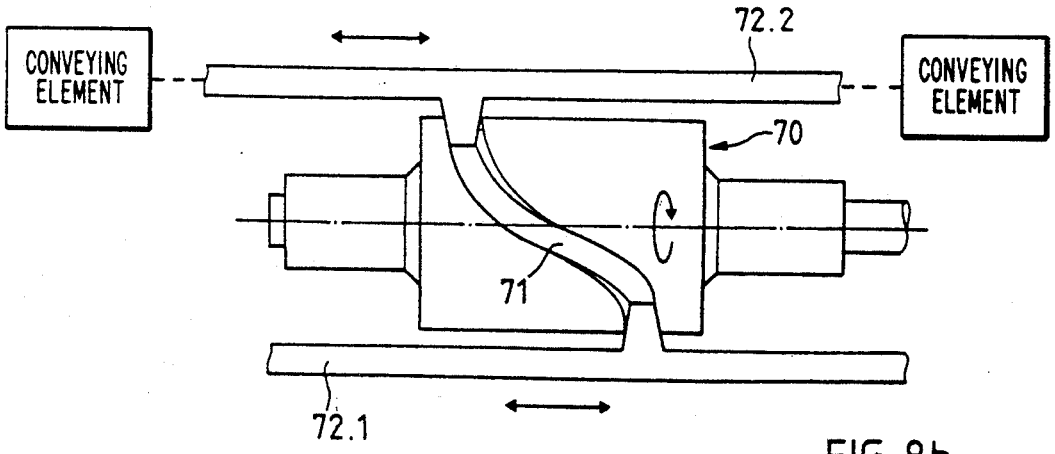

FIG. 8 shows the same gear as in FIG. 7. FIG. 8*a* shows an embodiment which can be used for driving two groups of conveying elements in the back-and-forth or reciprocating motion described with reference to FIGS. 5*a*–5*c*. In this case the cylinder 70 has two grooves 71.1, 71.2. By means of two connecting elements 72.1, 72.2 the individual, diagrammatically shown conveying elements 73 are driven. The construction of the gear with the corresponding movement link leads to a reciprocating movement of the conveying element 73 in the direction of the arrow. Elements 73 can correspond, for example, to elements 41.1, 41.2 or 51.1, 51.2 of FIGS. 5*a*–5*c*. FIG. 8*b* shows a gear intended for the same use as in FIG. 8*a*, but whose cylinder 70 only has one groove 71. The two connecting elements 72.1 and 72.2 are moved by corresponding sliding shoes, both of which run in the same groove 71, in the manner indicated by the arrow.

Figures 9A, 9B:
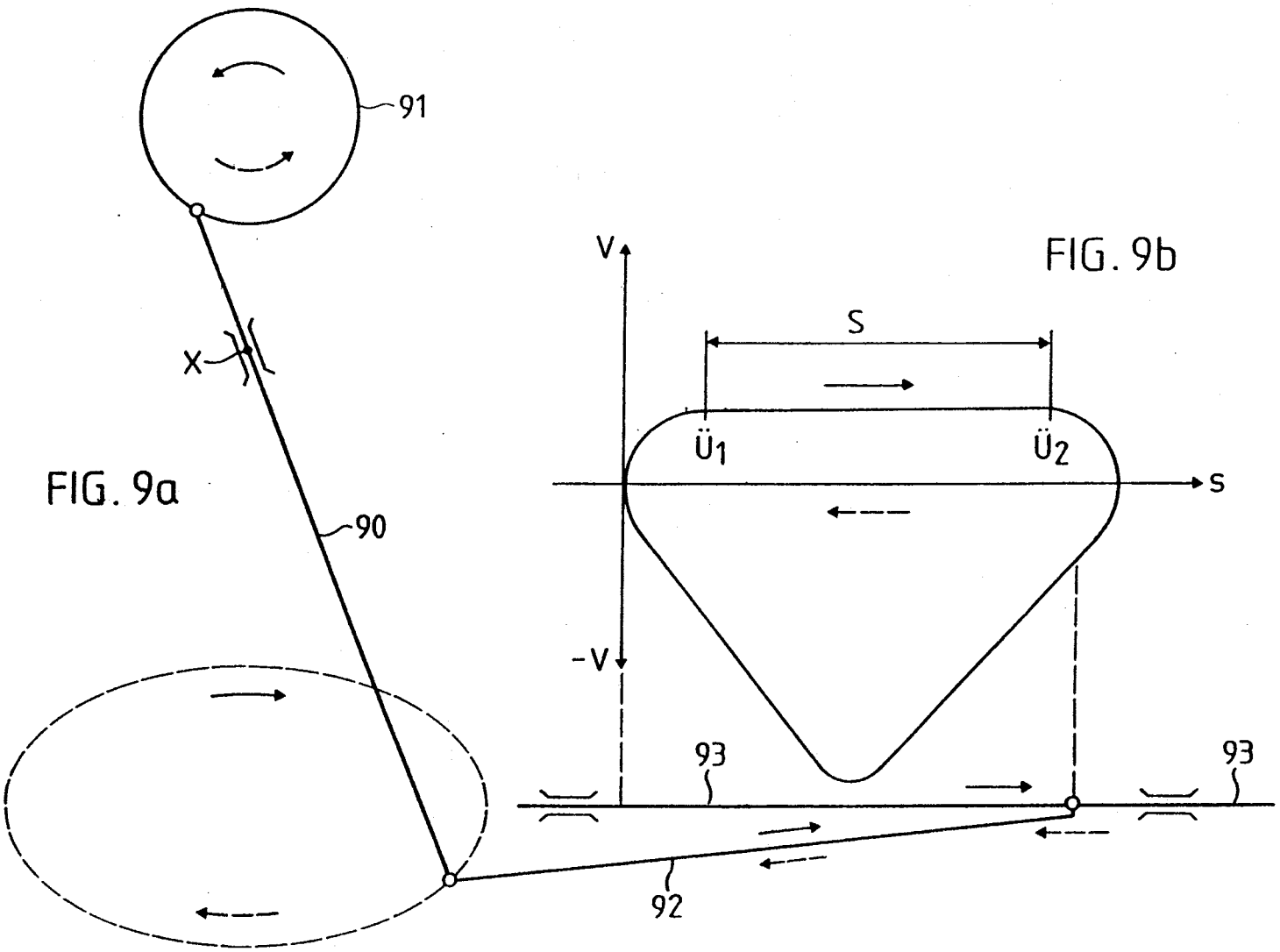
FIGS. 9*a*/9*b*: further variants of a gear.

FIG. 9*a* diagrammatically shows a gear with the aid of which it is possible to roughly produce the movement sequence for conveying elements in accordance with FIG. 1. As the corresponding movement sequence leads to a uniform conveying speed for the scale flow, it is ideally sought. It is a three-element slider crank gear. A crank 90 is moved by the driving pinion 91 and is guided at point X by a rotary sliding bearing. The non-driven end of the crank 90 performs an ellipitcal movement during which its speed is not constant. The intermediate lever 92 is connected in an articulated manner with the slider crank 90 and the carrier 93 carrying the conveying elements, so that the movement is transferred to said conveying elements. The resulting movement sequence is shown in FIG. 9*b* and permits an advantageous conveying of printed products with a substantially constant speed. The movement region marked S is used for conveying the printed products. The transfer of the printed products takes place at points $U_1$ and $U_2$.

The inventive conveying method has the aforementioned advantage that it is cycle-maintaining or cycle-regenerating. In conventional conveying systems, disturbing influences (friction, vibration, etc.) lead to a reciprocal displacement or twisting with respect to the conveying direction of the printed product conveyed in a scale flow. In particular following long conveying distances individual printed products can be so markedly displaced or twisted with respect to their predetermined position that during following working steps problems occur or said printed product must be removed. The scale flow has a fault at the corresponding point, which indirectly represents a conveying cycle disturbance. If such a fault or disturbance point reaches a work station (e.g. stitching), this must be taken into consideration. However, the inventive conveying method has the important advantage that after very short conveying sections the printed products are transferred and automatically there is an orientation or correction of the position of the individual printed products. Thus, faults or disturbances cannot be summated and are instead corrected during the initial phase. Thus, during each transfer/acceptance of a printed product the cycle is maintained or regenerated, if a fault has occurred. It is also possible to deliberately remove individual printed products from their predetermined position during one or more cycle times, e.g. in order to carry out work thereon. If the printed products are not positioned back outside a certain tolerance, during the following cycle (during the next transfer) the printed product is automatically brought back into its correct position.

I claim:

1. A method for conveying printed products in a scale flow along a path occupying a predetermined distance comprising the steps of dividing the predetermined distance into a plurality of portions S;

providing for each of the portions S at least two conveying elements for positively engaging and conveying at least one printed product over the length S, each conveying element having a conveying configuration;

alternatingly operating the conveying elements in each portion S to convey the printed products;

establishing a cycle length time T for conveying the at least one printed product over the portion S;

holding the cycle length time T constant for all portions S over the entire predetermined distance.

2. A method according to claim 1 wherein each of the conveying elements has a conveying and a non-conveying configuration, and wherein each said element assumes the non-conveying configuration and returns to the beginning of a portion for which it is provided while the other of the elements is in the conveying configuration and engaging a product.

3. A method according to claim 1 wherein a first one of the conveying elements conveys a printed product from a starting position to an ending position during a cycle $T_n$ while the second element moves toward a starting position and wherein the second element conveys a printed product from a starting position to an ending position during a cycle $T_{n+1}$ while the first element moves toward the starting position.

4. A method according to claim 1 wherein three conveying elements are provided for each step length S, and wherein a first one of the conveying elements conveys a printed product from a starting position to an ending position during a cycle $T_n$, the second element conveys a printed product from a starting position to an ending position during a cycle $T_{n+1}$, and the third element conveys a printed product from a starting position to an ending position during a cycle $T_{n+2}$, and wherein each conveying element returns to its starting position during conveying by other conveying elements.

5. A method according to claim 1 wherein the conveying elements provided for a portion S are synchronously moved and jointly driven.

6. A method according to claim 1 wherein each of the conveying elements is moved between starting and ending positions along the portion S over a travel distance H such that H=S.

7. A method according to claim 1 wherein conveying is accomplished by each element only over a portion of the travel distance H.

8. A method according to claim 7 wherein the travel distance H exceeds the length of the portion S at both ends.

9. A method according to claim 1 wherein the movement of the conveying elements along the path in the conveying direction is substantially constant over the entire travel distance H.

10. A method according to claim 9 wherein a part of the travel distance H over which speed of movement of an element is constant is defined as a portion S.

11. A method according to claim 1 wherein along the path adjacent portions $S_n$ and $S_{n+1}$ overlap for a distance $S_U$ and including, after an element has conveyed a product through the portion $S_n$, moving the element along a beginning of portion $S_{n+1}$ to a product engagement location $S_U$ to begin conveying in portion $S_{n+1}$.

12. A method according to claim 1 wherein all portions S are of equal length.

13. A method according to claim 1 and including moving the conveying elements provided for a selected portion $S_n$ through the portion is a time T' less that cycle length T whereby a waiting time $T_H=T-T'$ remains for each conveyed printed product.

14. A method according to claim 1 and including moving the conveying elements at substantially the same speed at a transition time at which elements provided for one portion S receive a printed product from elements provided for a preceding portion.

15. A method according to claim 1 and including varying the cycle time T available to each conveying element for conveying through a portion S after a selected time t wherein t is much greater than T.

16. An apparatus for conveying printed products in a scale flow in a direction along a path comprising the combination of a stationary support having a length equal to a selected conveying distance along which printed products are to be conveyed in steps each having a length S;

at least two conveying elements alternatingly movable relative to said support along each of said steps to positively engage and move said printed products; and means for driving said conveying elements.

17. An apparatus according to claim 16 wherein said selected conveying distance includes a plurality of portions arranged end-to-end, each portion including conveying elements for driving said printed products in said steps, and wherein said means for driving drives all of said elements in accordance with the same time cycle T.

18. An apparatus according to claim 17 wherein said support includes a slot and each said element includes a slide member slidably received in said slot, each said slide member being raisable into a conveying position and lowerable into a non-conveying return position.

19. An apparatus according to claim 17 wherein each said element includes a spring urging said slide toward said raised position.

20. An apparatus according to claim 16 wherein each of said conveying elements comprises a pair of lowerable angular slides at opposite sides of said support and means for adjusting the spacing between said slides.

21. An apparatus according to claim 16 wherein each said conveying element includes a slide member which is streamlined for movement counter to a direction of conveyance.

22. An apparatus according to claim 16 wherein said conveying elements are connected in groups to a common carrier for synchronous movement and wherein said common carrier is connected to said means for driving.

23. An apparatus according to claim 22 wherein said groups of conveying elements are connected to said common carrier by cross-arms (8) and connecting pieces (9).

24. An apparatus according to claim 16 wherein selected ones of said steps include a plurality of conveying elements arranged in rows, and wherein the conveying elements in each row are fixedly attached to a single carrier.

25. An apparatus according to claim 24 wherein said path includes curved portions and wherein said carriers are operatively connected to said drive means independently of each other, and wherein the lengths of said steps S along said curved portions are varied in proportion to the radius of curvature.

26. An apparatus according to claim 24 wherein said path includes curved portions and wherein said carriers are operatively connected to a common drive of said drive means and on said curved portions only one row includes conveying elements.

27. An apparatus according to claim 16 wherein said drive means includes a rotating cam cylinder with means defining at least one continuous groove, and a sliding shoe riding in said groove, said conveying elements being connected to said sliding shoe whereby the movement of said elements are controlled by the shape of said groove.

28. An apparatus according to claim 16 wherein said drive means comprises a three-element slider crank including a driving pinion (91), a slider crank (90) pivotally mounted at a point (X) and an intermediate lever (92), said conveying elements being operatively connected to said intermediate lever.

29. An apparatus for conveying printed products in a scale flow comprising the combination of a stationary support having a support surface and a length equal to a selected conveying distance along which printed products are to be conveyed in steps each having a length S, said support comprising a plurality of end-to-end portions having means defining a slot;

at least two conveying elements alternatingly movable relative to said support along each of said portions, each said element including a clamping device slidable in said slot, and means for lifting said clamping device into a raised and closed position above said support surface for conveying and lowering said clamping device into a lowered and open non-conveying position below said surface; and means for alternatingly driving said conveying elements in the conveying positions.

30. An apparatus for conveying printed products in a scale flow comprising the combination of a stationary support having a support surface and a length equal to a selected conveying distance along which printed products are to be conveyed in steps each having a length S, said support comprising a plurality of end-to-end portions;

at least two conveying elements alternatingly movable relative to said support along each of said portions, each said element including a clamping device slidable along a side of said support, and means for closing said clamping device for conveying and opening said clamping device when not conveying; and means for alternatingly driving said conveying elements in the conveying positions.

* * * * *